US009827451B2

(12) United States Patent
Renton et al.

(10) Patent No.: US 9,827,451 B2
(45) Date of Patent: Nov. 28, 2017

(54) HEIGHT RESCUE APPARATUS

(75) Inventors: Julian Elwyn Renton, Wiltshire (GB); Peter Thomas Mence Nott, Hampshire (GB)

(73) Assignee: FALLSAFE LIMITED, Hampshire (GB)

( * ) Notice: Subject to any disclaimer, the term of this patent is extended or adjusted under 35 U.S.C. 154(b) by 345 days.

(21) Appl. No.: 14/234,753

(22) PCT Filed: Jul. 25, 2012

(86) PCT No.: PCT/GB2012/051790

§ 371 (c)(1),
(2), (4) Date: Mar. 19, 2014

(87) PCT Pub. No.: WO2013/014453

PCT Pub. Date: Jan. 31, 2013

(65) Prior Publication Data

US 2014/0190770 A1 Jul. 10, 2014

(30) Foreign Application Priority Data

Jul. 27, 2011 (GB) ..... 1112901.2

(51) Int. Cl.
*A62B 1/10* (2006.01)
*A62B 35/00* (2006.01)
*A62B 35/04* (2006.01)

(52) U.S. Cl.
CPC ..... *A62B 1/10* (2013.01); *A62B 35/0093* (2013.01); *A62B 35/04* (2013.01)

(58) Field of Classification Search
CPC .... A62B 1/10; A62B 1/14; A62B 1/00; A62B 1/06; A62B 1/08; A62B 35/0093; A62B 35/04; A62B 35/0025; A62B 35/00
See application file for complete search history.

(56) References Cited

U.S. PATENT DOCUMENTS 4,493,396 A * 1/1985 Borgia ..... A62B 1/08 182/233
4,506,760 A * 3/1985 Baker ..... A62B 1/14 182/5
4,938,435 A * 7/1990 Varner ..... B64D 25/00 182/231

(Continued)

FOREIGN PATENT DOCUMENTS

CN 85107312 A 4/1987
CN 2215325 Y 12/1995

(Continued)

*Primary Examiner* — Katherine Mitchell
*Assistant Examiner* — Shiref Mekhaeil
(74) *Attorney, Agent, or Firm* — Carmody Torrance Sandak & Hennessey LLP

(57) ABSTRACT

There is provided a height rescue apparatus comprising a safety line (1) which is attached at (3) to a flexible elongate element (2) which has a lower tensile strength than the safety line 1 which is wound on a drum (9) which is part of a speed control means. A friction device (5) acts on a portion of the safety line (1) to reduce tension in said portion of the safety line by at least 50% in a full arrest situation. The drum (9) or the speed control means is held in a first position which prevents rotation of the drum and release means can be actuated after the fall arrest to allow the drum to provide a controlled lowering action.

20 Claims, 9 Drawing Sheets

(56) References Cited

U.S. PATENT DOCUMENTS

| | | | | |
|---|---|---|---|---|
| 5,379,858 | A * | 1/1995 | Sandoval | A62B 1/14 182/193 |
| 8,245,817 | B2 * | 8/2012 | Casebolt | A62B 35/0093 182/231 |
| 8,490,751 | B2 * | 7/2013 | Allington | A62B 1/08 182/234 |
| 9,121,462 | B2 * | 9/2015 | Casebolt | A62B 1/10 |
| 9,205,285 | B2 * | 12/2015 | Jones | A62B 1/14 |
| 2006/0113147 | A1 * | 6/2006 | Harris | A62B 35/0093 182/3 |
| 2009/0014242 | A1 * | 1/2009 | Tang | H04Q 9/00 182/241 |
| 2009/0084631 | A1 * | 4/2009 | Casebolt | A62B 1/10 182/235 |
| 2009/0173578 | A1 * | 7/2009 | Renton | A62B 1/08 182/235 |
| 2010/0252366 | A1 * | 10/2010 | Jones | A62B 35/0093 182/232 |
| 2010/0282541 | A1 * | 11/2010 | Renton | A62B 1/18 182/234 |
| 2015/0050515 | A1 * | 2/2015 | Gamba | A62B 35/0068 428/608 |
| 2016/0016023 | A1 * | 1/2016 | Myer | A62B 35/0037 242/370 |

FOREIGN PATENT DOCUMENTS

| | | | | |
|---|---|---|---|---|
| CN | 2726643 | Y | 9/2005 | |
| CN | 2801205 | Y | 8/2006 | |
| CN | 2870898 | Y | 2/2007 | |
| CN | 201115755 | Y | 9/2008 | |
| CN | 101720246 | | 6/2010 | |
| CN | 201500389 | U | 6/2010 | |
| CN | 201543126 | U | 8/2010 | |
| CN | 201840793 | | 5/2011 | |
| DE | 3531391 | A1 | 3/1987 | |
| GB | 1019462.9 | * | 11/2010 | A62B 35/00 |
| JP | 2006271912 | A | 10/2006 | |
| JP | 2011019662 | A | 2/2011 | |

* cited by examiner

HEIGHT RESCUE APPARATUS

CROSS REFERENCE TO RELATED APPLICATIONS

This application is a National Stage of International Application No. PCT/GB2012/051790, filed Jul. 25, 2012, the subject matter of which is herein incorporated by reference in its entirety.

This invention relates to a height rescue apparatus for use by personnel attached to fall arrest equipment whilst working at height. The height rescue apparatus has both a fall arrest function for arresting a fall from height and also a lowering function to lower the suspended faller to safety. The lowering function is typically initiated by either the faller or by another person.

Personnel working at height typically wear a harness that is attached in use to one end of a safety line, the other end of the safety line being attached to a secure anchor. Fall arrest equipment and systems vary widely according to each application. In many applications, the secure anchor may be an anchor point attached to a structure such as a building. In other applications the secure anchor may be a length of cable or track secured to a structure as part of fall arrest system such that the safety line attachment to the secure anchor is able move along the length of the cable or track. In some applications, the safety line may be incorporated into a self retracting block such that safety line is able to extend and retract to allow the user a range of movement relative to the secure anchor. In the event of the user falling, the self retracting block normally has a brake that is applied to arrest the fall. Other applications may involve the necessity for the user to be attached to one or more safety lines that may then be attached to one or more secure anchors.

Arresting a person from a fall can impart high tensile forces to the safety line depending on the amount of fall energy needing to be absorbed and the way that the fall energy is dissipated by each component typically between and including the faller and the structure to which the secure anchor is attached. It is usual with current fall arrest equipment to include a specific energy absorber between the faller and the secure anchor to control and limit the arresting force applied to the faller and therefore also the arresting force on the safety line and secure anchor. Typically, the tensile force on the safety line is limited to 6 kN or less.

In addition to the need for safety lines to withstand high arresting forces, they also need to withstand a high degree of wear and tear, degradation from environmental effects such as ultra violet light from the sun and contact with a large variety of potentially harmful chemicals. Safety lines are also required to withstand contact with abrasive materials such as concrete and sharp corroded metal surfaces particularly where these abrasive materials form an obstruction or edge that a safety line is bent around whilst resisting high tensile forces as a result of arresting a fall. The greater the bend angle the greater is the resultant force between the safety line and the edge material as a component of the tensile force on the safety line. The abrading effect is also proportional to the coefficient of friction between the safety line and the edge surface so that a typically rough surface material such as concrete is likely to be particularly abrasive. In some applications, the safety line may be bent around an angle of as much as 90 degrees whilst arresting a fall. For example, a person might fall over the edge of a horizontal flat roof, their safety line being attached to a secure anchor located on the flat roof surface.

In recognition of the demands placed on safety lines in use, industry standards have evolved to ensure that they are both strong and have a substantial cross-sectional area. The requirement for strength for many safety lines is that they should be capable of resisting loads of 22 kN without breaking. There are also further industry standards that specify a minimum cross sectional areas depending on the safety line material and nature of the fall arrest system in use. One typical safety line is known as a lanyard. Rope lanyards made of man made fibre tend to have a minimum cross sectional diameter of 11 mm (95 sqmm area) and webbing lanyard have a rectangular cross section of 25 mm wide by 4 mm thick (100 sqmm area).

After a person has been arrested from a fall it is normal for the person to be suspended at height awaiting rescue. Various lowering devices are known that are typically carried on a person's harness whereby, after a fall has been arrested, lowering can be initiated either by the person suspended or by another person close by. These devices typically have a length of lowering line stored on a drum or in a bag that can be deployed to lower a person to the ground or some other safe level. Some of these devices incorporate means for automatically controlling the speed of descent and there are also devices that include a manually operated brake.

The industry standard requirement for lowering line used in lowering devices is significantly different to the requirement for safety line connecting a person to a secure anchor. The forces generated when lowering a person at a controlled steady speed of descent are close to being static and are determined largely by the weight of the person descending. A person, for example, weighing around 140 kgs would generate forces in the lowering line of around 1.4 kN. Some industry standards recommend a factor of safety of 5 times so that the lowering would need to resist a maximum tensile force of around 7 kN. This compares with the minimum tensile strength requirement for fall arrest safety line of 22 kN.

Lowering line is only required to perform its function in the unlikely event of a person having been arrested from a fall. It is therefore not subject to the continuous wear and tear that a safety line would be expected to endure. Lowering line is also generally protected within a housing from potential environmental and chemical degradation that a safety line would be widely exposed to. Since the lowering function is only initiated after a fall has been arrested, there is substantially less potential for the lowering line to suffer the same degree of abrasion on material edges as compared with safety line. It is therefore possible for lowering line to be less strong than safety line and to have a significantly smaller cross sectional area than safety line. For example, it is possible to fulfil the requirement for lowering line with 5 mm diameter cross section rope as compared with 11 mm diameter cross section rope for a safety line lanyard such for a given length of line, the volume of lowering line may be as little as a fifth of the volume of safety line. In general, it is desirable for man made fibre lowering line to have a cross sectional area of less than half the cross sectional area of man made fibre safety line and for a given length of lowering line to be no more than 50% of the weight of the same length of safety line.

The ability for lowering line to have a relatively small cross sectional area as compared with safety line is significant for various reasons. Firstly, where a user is carrying a lowering device attached to a harness it is important that the lowering device is lightweight and compact. Secondly, users will be working at a wide range of heights and so it is useful for a lowering device to cater for the larger descent distances such as 20 m and 40 m that would be impractical if using safety line to perform the lowering function as well as the fall arrest function. Thirdly, using relatively small rope for the lowering function enables the height rescue apparatus to be physically small and therefore cost effective to produce.

GB 2414005 discloses a personal height rescue apparatus that comprises a load element releasably held in a first position relative to a bracket, one of the load element or the bracket being for attachment in use relative to a harness, a safety line having one end attached relative to the other of the load element or the bracket, the other end of the safety line in use being attached to a secure anchorage, a lowering line being secured at one end to the load element and at the other end to a speed control means, release means for releasing the load element from the said first position, such that when the load element is released the load element is able to move relative to the bracket at a controllable speed to provide a controlled speed of descent.

Many of the embodiments described in the accompanying figures in GB 2414005 show the load element being releasably secured relative to a bracket. However, FIG. 12*a* and FIG. 12*b* show a comparatively straightforward release arrangement whereby the lowering line is secured to and wound onto a drum mounted for rotation. The drum is held in a first position by means of a pawl acting directly on the drum relative to a bracket. In the event of a person being arrested from a fall the arrest forces are transmitted to the lowering line wound onto the drum. In order to initiate the person's descent the pawl is moved to a second position away from the drum allowing the drum to rotate. Rotation of the drum is controlled by a speed control means so that the person is lowered at a controlled speed of descent. In order to avoid fall arrest forces acting directly on the relatively small lowering line stored on the drum when the drum is held in said first position, a length of strong line typically with a higher cross sectional area than the lowering line is attached at one end to the load element and the other end is then wound around the drum for a number of turns to reduce line tension through radial friction before the strong line is attached to one end of the relatively small and less strong lowering line that is also wound around the drum with its other being secured to the drum.

A problem with this arrangement can be that it is difficult to ensure that there is sufficient friction between the line wound onto the drum and the surface of the drum to ensure that line tension applied to the strong line is not substantially transferred to the secure attachment of the less strong lowering line to the drum. Another significant problem with this arrangement is that fall arrest forces are transferred directly to the drum, pawl and their supporting mechanisms making them heavy and costly to construct. Also, high loading on the length of strong line on the drum can be transferred to the less strong lowering line close to or at its secure attachment thereto if there is insufficient frictional resistance between the wound bulk of lowering line on the drum and its contact with the surface of the drum. Furthermore, without any means for reducing loading on the drum during both a fall arrest event and also descent, there may be a tendency for the lowering line leaving the drum to bury into the wound bulk of lowering line on the drum particularly if the drum is wide between end flanges. This can disrupt the descent function and in severe cases stop lowering line from leaving the drum.

This invention provides an improved arrangement.

According to the present invention there is provided a height rescue apparatus having both a fall arrest function and a lowering function, the apparatus comprising:

- an elongate safety line which in use has one end secured with respect to a secure anchorage device;
- a friction device mounted on a bracket having harness attachment means, which friction device acts upon a portion of the safety line towards the other end thereof remote from said one end in order to reduce tension in the end of said portion of safety line by at least 50% in a fall arrest situation;
- an elongate lowering line which has a first end attached to said other end of the safety line and which has a lower tensile strength than the safety line;
- a drum mounted on the bracket for rotation relative thereto, around which drum the lowering line is wound and to which drum the second end of the lowering line is secured,
- at least one speed control means for controlling the speed of rotation of the drum, one of the drum or the speed control means being releasably held in a first position which prevents rotation of the drum,
- release means for releasing the drum or the at least one speed control means from said first position to allow the drum to rotate at a controlled speed in a lowering situation and to allow lowering line to be deployed to provide a controlled speed of descent.

Preferred features are set out in the attached set of claims.

A simple construction for enabling the lowering line to have a lower tensile strength than the safety line is to have the lowering line to be of smaller cross-sectional area than the safety line. However technology is such that different elongate elements could have the same or similar cross-sectional areas but the safety line could still have a significantly greater tensile strength than the lowering line. Said safety line could also comprise of one or more lengths of flexible elongate with means for attaching lengths together in series or in parallel and further means for attachment to one or more secure anchors. For example, the safety line may comprise a doubled-up or tripled up (or other multiple) section of the elongate lowering line. Said safety line may include one or more energy absorbers that could provide useful control of tensile loading in the safety line. Said safety line may be self retracting or be attached to one or more self retracting lines. Where the safety line comprises a number of parallel lengths of elongate, the cross-sectional area of the safety line is the sum of the cross-sectional areas of the elongates.

A preferred method for applying friction to the safety line provided by the said friction means is to constrain the safety line through a non linear path relative to the bracket such that, given the coefficient of friction between the constraining surface(s) and the surface of the safety line, the sum of the angular deviations is sufficient to reduce tensile loading in the safety line by at least 50 percent. Alternatively, the friction means could include a clamping means acting on the surface of the safety line to provide frictional resistance to reduce tensile loading in the safety line by at least 50 percent.

It is preferable for a length of lowering line to weigh no more than 50 percent of the same length of safety line and, where the lowering and safety lines are made of similar materials, for the cross sectional area of lowering line to be no more than 50 percent of that of the safety line A preferred object of this invention is therefore to provide a height rescue apparatus with a means for significantly reducing loading on the lowering line leading on to the drum thereby preventing high loading from being transferred to the drum, speed control and release means and their supporting mechanisms. This enables the present apparatus to incorporate a lowering mechanism having friction device which is independent of the drum and speed control mechanism thereby preventing the drum, speed control mechanism and release mechanism from being required to withstand high loading such as when arresting a fall and thereby allowing a light weight and cost effective construction.

The invention will now be described by way of example only with references to the accompanying diagrammatic figures in which:

FIG. 1*a* shows a height rescue apparatus according to a first embodiment of the present invention:

FIG. 1*b* shows a height rescue apparatus similar to FIG. 1*a* but with a slight modification;

FIG. 2 shows a side elevation of the embodiment in FIG. 1;

FIG. 2*a* shows a partially cut away view of the friction means in FIG. 2;

FIG. 2*b* shows a partially cut away view of an alternative arrangement of the embodiment in FIG. 1;

FIG. 2*c* shows a further alternative arrangement of the embodiment in FIG. 1;

FIG. 3 shows the embodiment in FIG. 1 with an alternative friction means;

FIG. 3*a* shows a partially cut away view of the friction means in FIG. 3 in an open position without elongate in place;

FIG. 3*b* shows a partially cut away view of the friction means in FIG. 3 in a closed position with elongate in place;

Figure 8A:
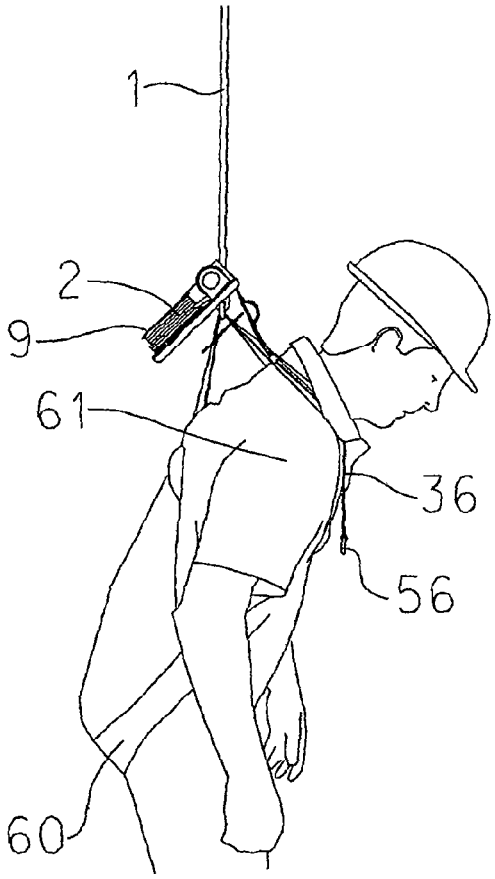
Figure 8B:
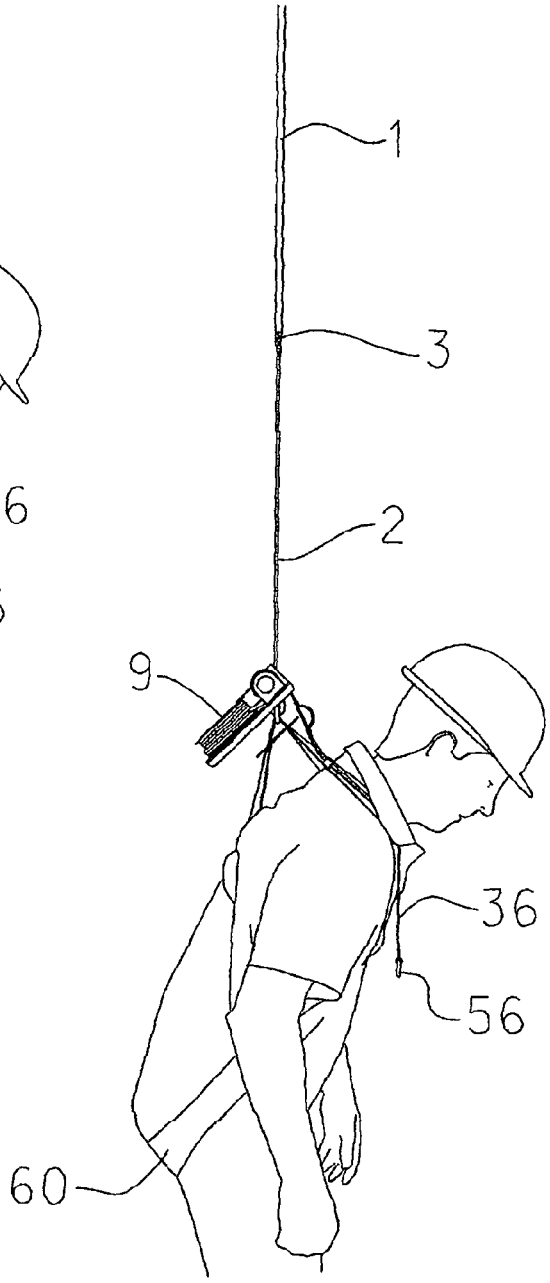

FIG. 8*a* shows the embodiment in FIGS. 1 to 5 attached to a harness worn by a person suspended such as following a fall from height;

FIG. 8*b* shows the person in FIG. 8*a* descending following suspension.

Figure 1A:
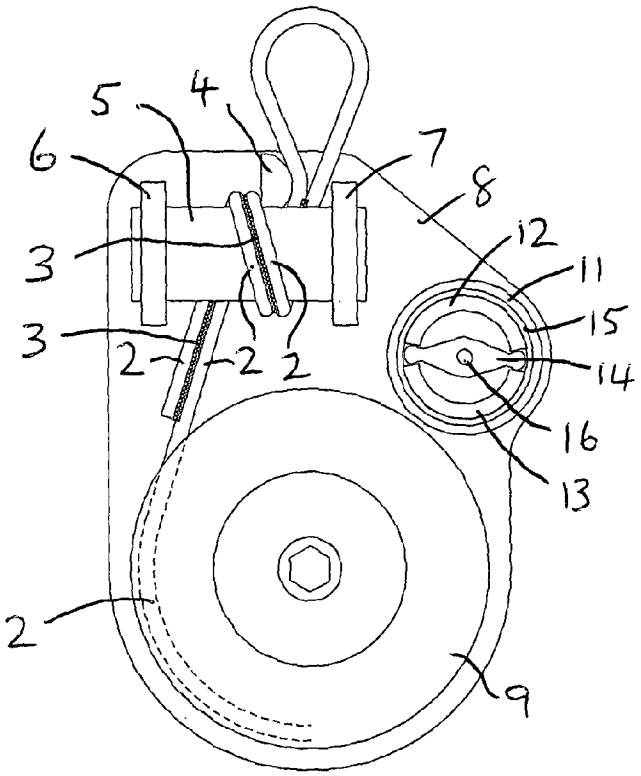
Figure 1B:
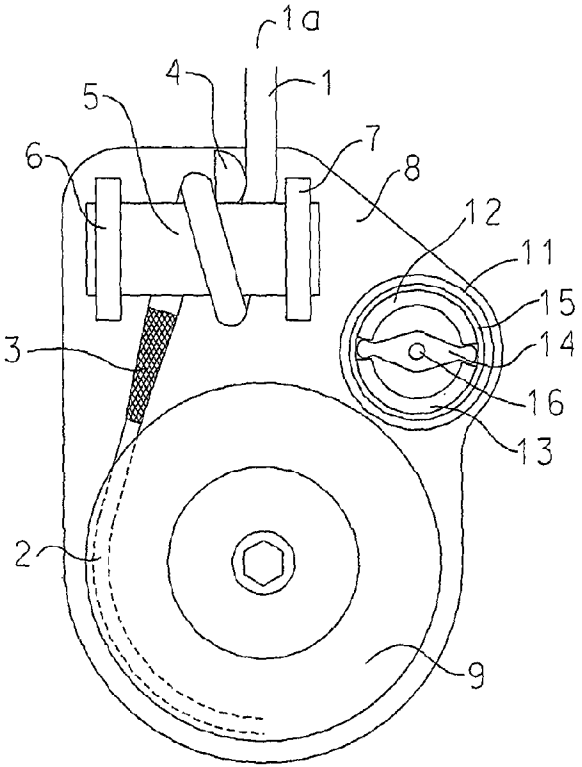
Figure 2A:
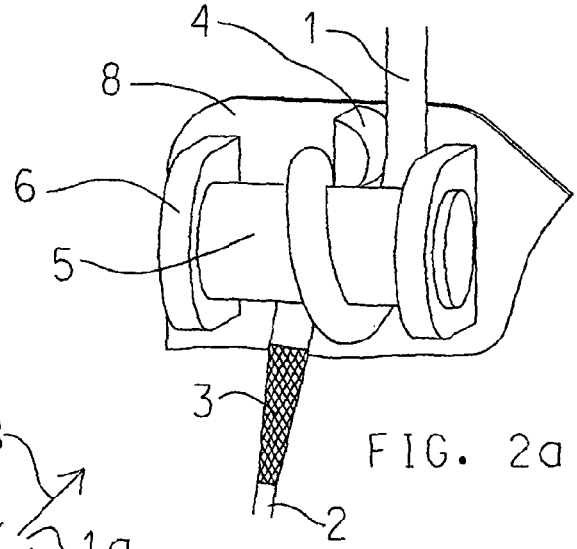
Figure 2:
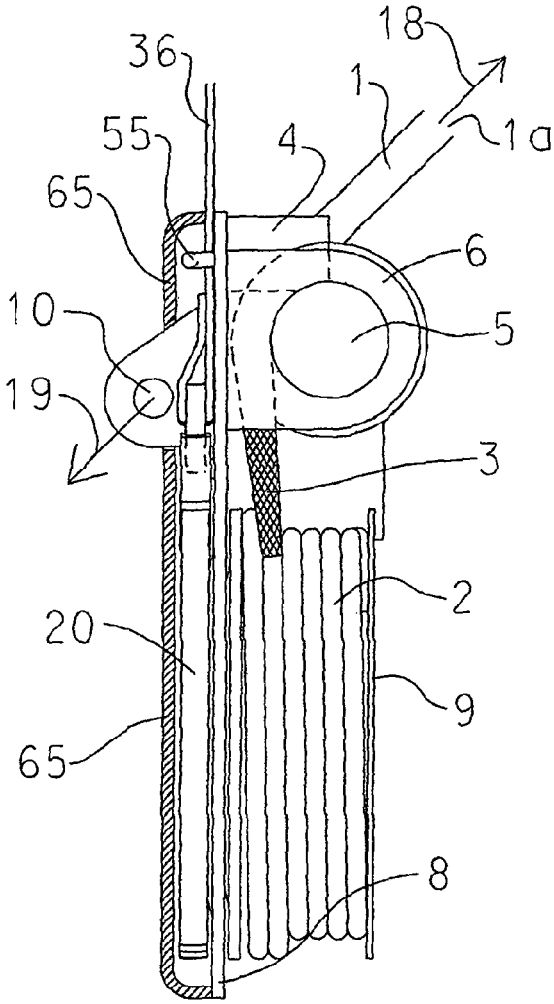
Figure 2B:
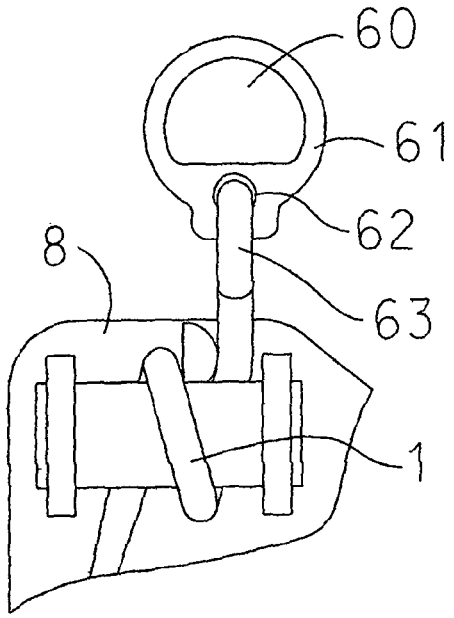

In FIG. 1*a* and FIG. 1*b* elongate 1 is a safety line that is attachable in use at one end to a secure anchor by means of a karabiner for example and the other end is attached to one end of a comparatively smaller elongate 2 that is wound around a drum 9, the other end of elongate 2 being securely attached to drum 9. The smaller elongate 2 has a lower tensile strength than safety line 1 and this may be by virtue of a smaller cross-sectional area. FIG. 2*b* shows the one end of elongate 1 that is attached to a secure anchor in FIG. 1 being attached instead to D ring 61 to provide an attachment for one or more further safety lines that can then be attached to one or more secure anchors. D ring 61 is typically made of steel or aluminium and has aperture 60 to enable a variety of connecting devices to be attached to it. The attachment of elongate 1 to D ring 61 is shown as being a secure closed loop as in loop 63 made in the end of elongate 1 with the loop passing through hole 62 in D ring 61. Alternatively, loop 63 could in itself provide an attachment for further safety lines.

In FIG. 1*a* the attachment between elongate 1 and 2 is shown at region 3 as being by means of splicing. However, the attachment of elongate 1 to elongate 2 could be by any means for joining elongates such as the interconnection of loop ends, sewing, the tying of a one or more knots or attachment to one or more interconnecting mechanical links. Alternatively, elongate 1 and 2 could be manufactured as a continuous elongate with a portion forming elongate 1 having a larger cross sectional area, and thus greater tensile strength, than a portion forming elongate 2. A further alternative is shown in FIG. 1*b* in which the safety line 1 comprises a doubled-up portion of elongate 2, the doubled-up portions being secured together by splicing or stitching for example.

In FIG. 1*a* and FIG. 1*b*, elongate 1 is constrained by guide 4 before being wound around a fixed cylinder 5. Cylinder 5 is firmly attached at either end to brackets 6 and 7 and bracket 6 and 7 are then securely attached to chassis 8 such that there is sufficient space between cylinder 5 and chassis 8 to allow elongate 1 to pass. Chassis 8 is typically a plate with a suitably profiled perimeter. FIG. 2 shows an attachment 10 for attaching the height rescue apparatus preferably but not necessarily to a harness worn by a person when working at height. Attachment 10 is shown as a hole in a plate, the plate being securely attached to or forming part of chassis 8 with the plane of the plate being typically perpendicular to the plane of the chassis. The location of attachment 10 on chassis 8 is opposite elongate 1 such that a tensile force can be applied between attachment 10 and elongate 1 with the direction of force and its reaction shown at arrows 18 and 19 respectively. When a tensile force is applied to elongate 1 at end 1*a* relative to attachment 10, the tension in elongate 1 as it is wound onto cylinder 5 is reduced by at least 50 percent by circumferential friction between elongate 1 and the surface of cylinder 5, depending on the coefficient of friction between the interacting surfaces and the radial angle through which elongate 1 is wound onto cylinder 5. FIG. 2 and FIG. 2*a* show the winding of elongate 1 around the fixed cylinder 5 through a radial angle of at least 180 degrees or $\pi$ (approximately 3.142) radians. The actual radial angle will depend on the direction of the applied tension on elongate 1 at its end 1*a* with respect to the plane of chassis 8. Generally, the mechanics of the friction means in FIG. 2 and FIG. 2*a* to reduce tension in elongate 1 is represented by the following formula:

$$\frac{T_1}{T_2} = e^{\mu\theta}$$

In the above formula, $T_1$ is the applied tension at end 1*a* of elongate 1, $T_2$ is the tension in elongate 1 after being wound around cylinder 5, e is a mathematical constant approximating to 2.7183, $\mu$ is the coefficient of friction between the surface of elongate 1 and the surface of cylinder 5 and $\theta$ is the radial angle in radians through which elongate 1 is wound around cylinder 5. The formula shows that $T_2$ is proportionate to $T_1$ and that the percentage tension reduction is defined by both $\mu$ and $\theta$ and is not dependent on the diameter of cylinder 5.

Figure 3A:
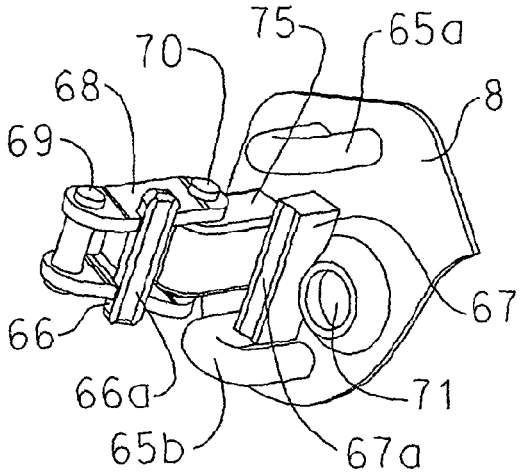
Figure 3B:
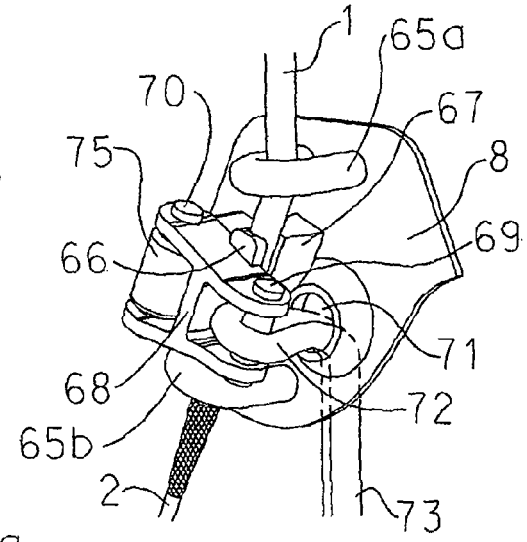
Figure 3:
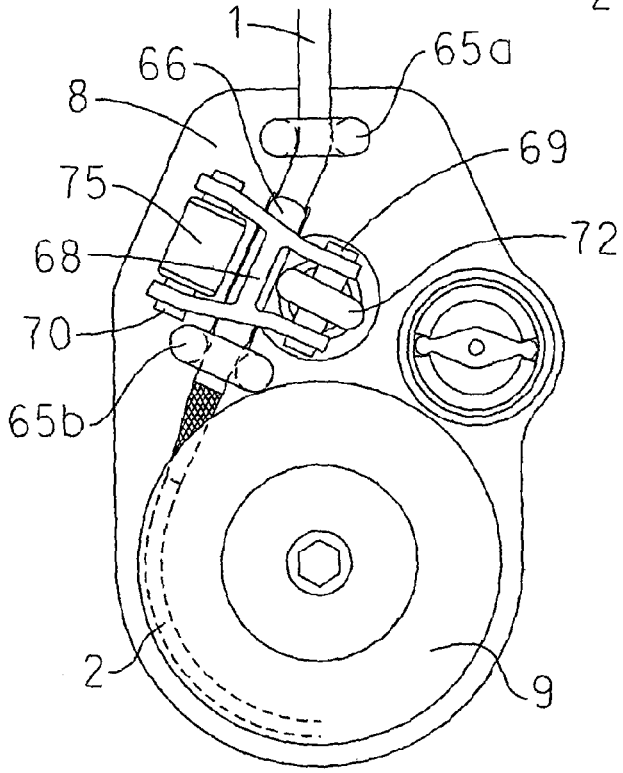

FIG. 3, FIG. 3*a* and FIG. 3*b* show an alternative friction means that operates by clamping elongate 1 between two surfaces whereby the clamping force on elongate 1 is a function of the tension in the connection of the invention to a harness such as harness 61 in FIG. 8*a* and FIG. 8*b* and therefore also the tension in elongate 1. FIG. 3*a* shows the clamp mechanism in an open position without elongate 1 in place for explanatory purposes whereas FIG. 3 and FIG. 3*b* show the clamp mechanism applied either side of elongate 1 in a closed position. Clamp 68 has a rigid longitudinal bar, bar 66, fixed to or incorporated into a structure with provision for axle 69 and axle 70 having parallel axes mounted either side of bar 66 and with bar 66 having its longitudinal axis parallel to both axles 69 and 70. Surface 66*a* on bar 66 is suitably formed such that a part of the length of elongate 1 or 2 can be pressed against the corresponding length of bar 66 along the length of surface 66*a*. Protrusion 75 is a protrusion rigidly attached to or integral with chassis 8 and provides a mounting for axle 70 such that clamp 68 is able to rotate about axle 70 relative to protrusion 75. Bar 67 is a longitudinal bar that is rigidly attached to or integral with chassis 8 with its longitudinal axis parallel to the substantial plane of chassis. Surface 67*a* on bar 67 is suitably formed so that a part of the length of elongate 1 or elongate 2 can be pressed against the corresponding length of bar 67. Bar 67 is positioned on chassis 8 with its longitudinal axis parallel to bar 66 on clamp 68 such that when clamp 68 is rotated about axle 70 towards bar 67, surfaces 66*a* and 67*a* oppose each other. The longitudinal axis of elongate such as elongate 1 and/or elongate 2 is constrained between guides 65*a* and 65*b*. Guides 65*a* and 65*b* are shown as each comprising a length of circular section bar that has been bent through 180 degrees to form an aperture that corresponds with the circular section of elongate 1 and with the ends of each circular section bar being securely attached to chassis 8. Both guides 65*a* and 65*b* are located on chassis such that when elongate 1 is passed through each guide, elongate 1 is constrained between said guides so that at least part of the length of elongate 1 is positioned between and longitudinally aligned with opposing surfaces 66*a* and 67*a* so that when clamp 68 is rotated about axle 70 towards bar 67, surfaces 66*a* and 67*a* contact with opposing surfaces of elongate 1 such as is shown in FIG. 3 and FIG. 3*b*. FIG. 3 and FIG. 3*b* show elongate 73 passing through a circular aperture typically in the plane of chassis 8 and securely attached at one end to axle 69 on clamp 68 by means of loop 72 that is a looped end made in elongate 73. The other end or ends of elongate 73 is or are attached in use to a harness. When a tension is applied to elongate 73 between the invention and its attachment to a harness, loop 72 pulls on axle 70 thereby clamping surfaces 66*a* and 67*a* onto either side of elongate 1. The clamping force applied to opposing surfaces of elongate 1 results in friction being applied to elongate 1 with respect to chassis 8 thereby resisting movement of elongate 1 along its constrained path between guides 65*a* and 65*b* thereby reducing tension in elongate 1 as it passes from the clamping means to drum 9. The mechanics of the friction means in FIG. 3, FIG. 3*a* and FIG. 3*b* can generally be represented by the following formula:

$$F=(\mu_1 \times N_1)+(\mu_2 \times N_2)$$

In the above formula, F is the friction applied to elongate 1 resisting its movement through the clamping means, $\mu_1$ is the coefficient of friction between the surface of elongate 1 and surface 67*a* on bar 67 and $\mu_2$ is the coefficient of friction between the surface of elongate 1 and surface 66*a* on bar 66, $N_1$ is the clamping force between elongate 1 and surface 67*a* and $N_2$ is the clamping force between elongate 1 and surface 66*a* on bar 66. The amount of friction applied to resist movement of elongate 1 and to cause a useful tension drop on the drum side of the clamping means is therefore a function of the size of the overall applied clamping force on elongate 1 as well as the nature of the clamped contact surfaces.

Since elongate 73 provides the attachment of the invention to a harness, the tension in elongate 73 at its attachment to a person's harness such as in FIG. 8*a* and FIG. 8*b* is essentially resisting the same tension as that in elongate 1, both elongate 73 and elongate 1 being mechanically connected to resist load applied between the person and the secure anchorage to which elongate 1 is attached. In the event of a person falling or being suspended after a fall, the amount of clamping force applied to elongate 1 is therefore also proportionate to the tension in elongate 1.

Whilst the clamping means in FIG. 3, FIG. 3*a* and FIG. 3*b* is shown as being principally applied to elongate 1 it may also usefully be applied to elongate 2 after elongate 1 has been deployed from the invention such as when a person is descending.

If the height rescue apparatus is attached to a person's harness in use and elongate 1 is attached to a secure anchor with drum 9 held to resist or stop its rotation and the person is arrested from a fall from height, the maximum tensile loading in elongate 2 will be significantly lower than the tensile loading in elongate 1 as a result of the friction means as shown in FIG. 2 and FIG. 2*a* and also in FIG. 3, FIG. 3*a* and FIG. 3*b* thereby enabling elongate 2 to be made from significantly less strong elongate than elongate 1 As discussed above, this strength difference could be the result of a smaller cross section for the lowering elongate 2. Also, the load transferred to related mechanisms such as drum 9 and associated release means will be significantly reduced enabling the height rescue apparatus with comparatively less strong elongate 2 to be light weight, compact and cost effective. In any friction means to reduce tensile loading in elongate 1, it is preferred that the applied friction, at least in part, is a function of the tension in elongate 1 so that any reduced tensile load in elongate 1 as a result of the friction means is substantially proportionate to the applied tensile load in elongate 1 before reduction. This helps to ensure that when drum 9 is released elongate 1 can move relative to the friction means irrespective of whether elongate 1 is sustaining a relatively small load such as supporting the static weight of a person or a significantly higher load such as that associated with arresting a person from a dynamic fall.

Figure 2C:
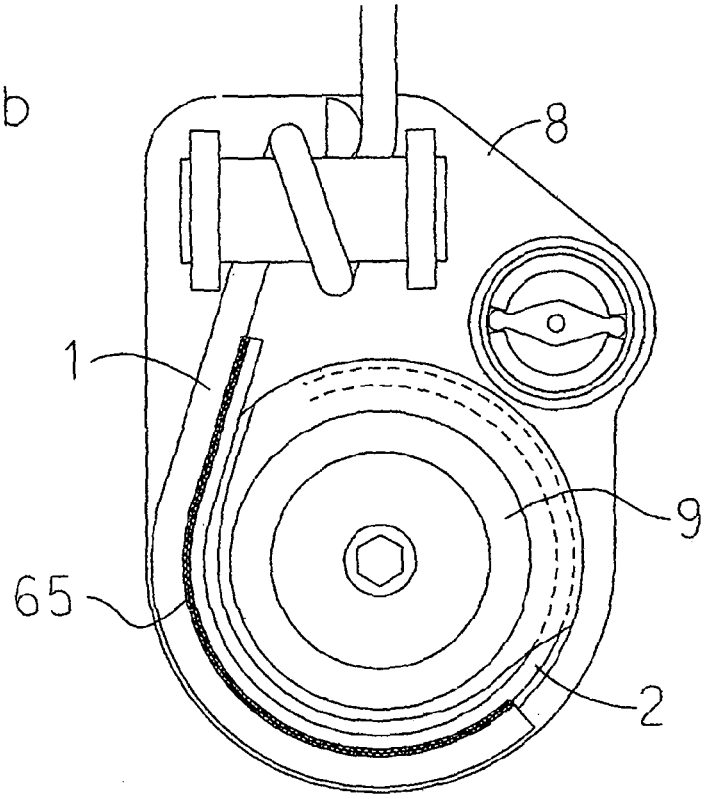

Whilst the attachment of elongate 1 to elongate 2 is typically located between cylinder 5 and drum 9, it may be convenient to extend elongate 1 around drum 9 for one or more turns before making its attachment to elongate 2. FIG. 2*c* shows elongate 1 being sewn to the smaller elongate 2 whereby the length of the sewn interconnection shown as 65 is partially wound around drum 9 to enable the height rescue apparatus to be compact.

Drum 9 is mounted for rotation and its rotational speed is controlled by a speed sensitive control means including a centrifugal brake. A typical centrifugual brake arrangement is shown in FIG. 1 having a circular tubular housing 11 one end of which is attached to or is part of chassis 8 and the inner surface of the tubular housing having a brake lining material 15. Radial shoes 12 and 13 are configured such that they can rotate around the internal wall of housing 11 when driven by drive arm 14 that is mounted for rotation about axis 16. When drive arm 14 is urged to rotate, shoes 12 and 13 are pressed against brake lining material 15 as a result of centrifugal forces thereby resisting the rotation of drive arm 14, the degree of such resistance being dependent on the speed of rotation of drive arm 14.

Figure 4:
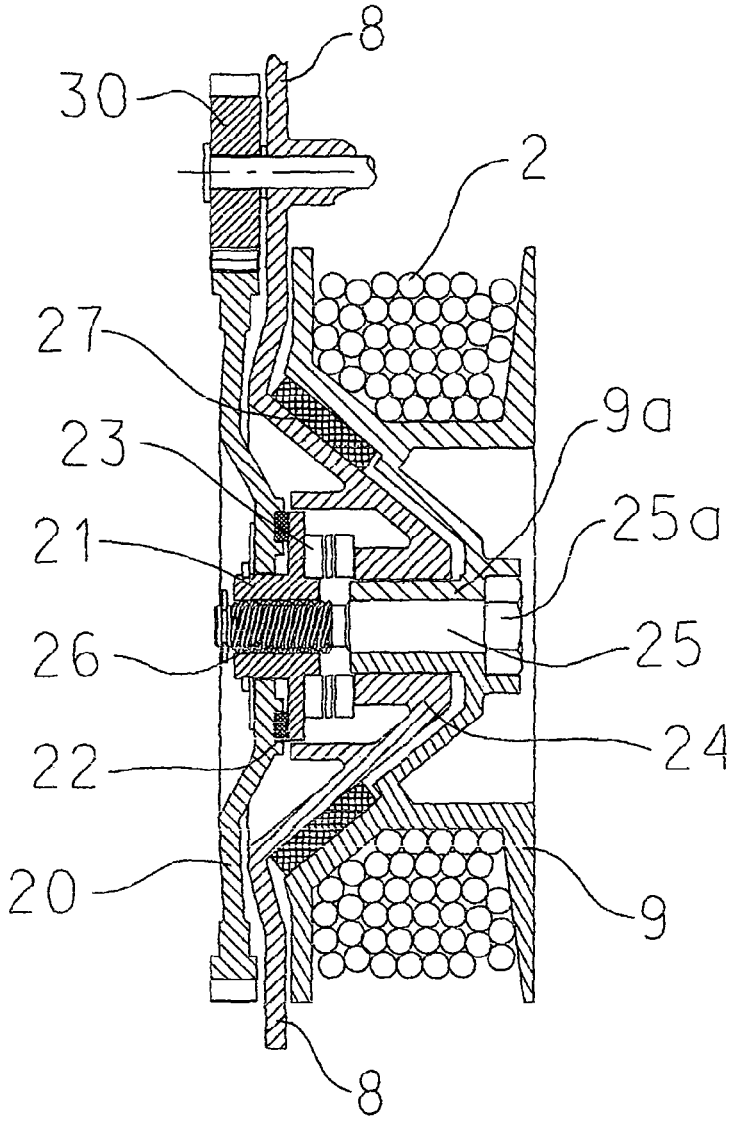
FIG. 4 shows a partially cut away view of a speed control means in the embodiment in FIG. 1.
Figure 5:
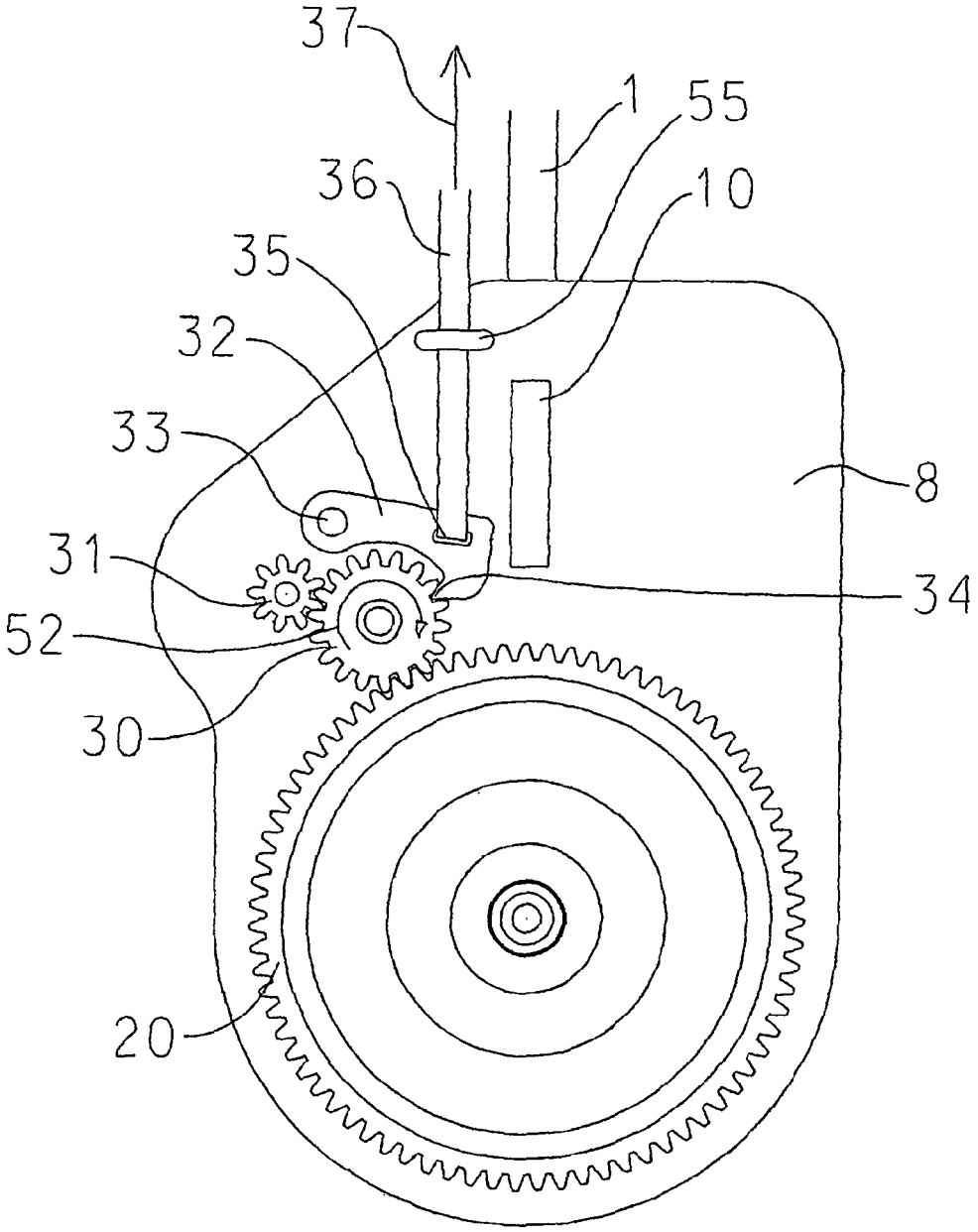
FIG. 5 shows a reverse view of the embodiment in FIG. 1 with release means.

FIG. 4 shows a typical mechanism, which together with the centrifugal brake arrangement in FIG. 1 provides a suitable speed sensitive arrangement for controlling the speed of deployment of elongate from drum 9. Bolt 25 is mounted in the central axis of drum 9 and is constrained to rotate with drum 9 as a result of the hexagonal head 25*a* of bolt 25 being held in a hexagonal recess in drum 9. Bolt 25 has a threaded portion 26 that engages with a corresponding threaded portion of nut 21. Nut 21 is held against spur gear 20 so that they rotate together. In FIG. 5, Spur gear 20 intermeshes with idler gear 30 thereby driving spur gear 31 that is attached to drive arm 14 in FIG. 1 in the centrifugal brake assembly. Chassis 24 is attached to or a part of chassis 8 in FIG. 1 and provides a central hole through which to locate a central axle 9*a* mounted on drum 9 such that drum 9 can rotate with respect to chassis 24. Conical brake material 27 lies between drum 9 and chassis 24 such that the rotation of drum 9 is resisted as drum 9 and chassis 24 move together. Bearing 23 is typically a roller bearing that lies between chassis 24 and nut 21. When drum 9 is rotated to enable deployment of elongate 1, bolt 25 and nut 21 tend to rotate together thereby allowing rotation of spur gear 20 to drive the centrifugal brake. When the speed of rotation of drum 9 exceeds a predetermined limit the centrifugal brake transmits a resistive torque back to nut 21 so that bolt 25 tightens in nut 21 urging drum 9 towards chassis 24 such that conical brake material 27 acts on either the drum or the chassis to slow the rotational speed of drum 9. When drum 9 slows to a predetermined limit the centrifugal brake also slows and reduces its resistive torque on spur gear 20 thereby allowing nut 21 to loosen relative to bolt 25 thereby allowing drum 9 to move away from chassis 24 so that the speed of rotation of drum 9 can increase. In this way the speed of rotation of drum 9 is controlled according depending on the speed of rotation of drum 9 and the centrifugal brake acts as a servo mechanism to the main frictional brake provided by conical brake material 27 between drum 9 and chassis 24.

When a person is arrested after fall, drum 9 is held to avoid the deployment of elongate 2. However, when the person is suspended and needs to descend, the drum can be released to allowing descent at a controlled speed. FIG. 5 shows a means of both holding and releasing the drum. Spur gear 20 intermeshes with idler gear 30 and spur gear 31. Spur gear 31 is attached to drive arm 14 in FIG. 1 driving the centrifugal brake. Link 32 pivots about axle 33 and in a first position has tooth 34 that engages with idler gear 30 to prevent idler gear 30 from rotating in the direction of arrow 52 thereby preventing relative rotation of spur gear 20. In FIG. 4, when spur gear 20 is held, drum 9 is drawn towards chassis 24 onto conical brake material 27 thereby stopping rotation of drum 9. In order to allow rotation of drum 9, link 32 in FIG. 5 is rotated about axle 33 so that tooth 34 moves away from engagement with idler gear 30 and the gears are free to rotate. Cord 36 is shown as a pull cord attached at 35 to link 32 so that when cord 36 is pulled in the direction of arrow 37, drum 9 is released and able to rotate. Guide 55 provides guidance for cord 36 such that cord 36 is constrained between its attachment to link 32 and guide 55 whilst having freedom to extend in various directions having passed beyond guide 55.

Figure 6:
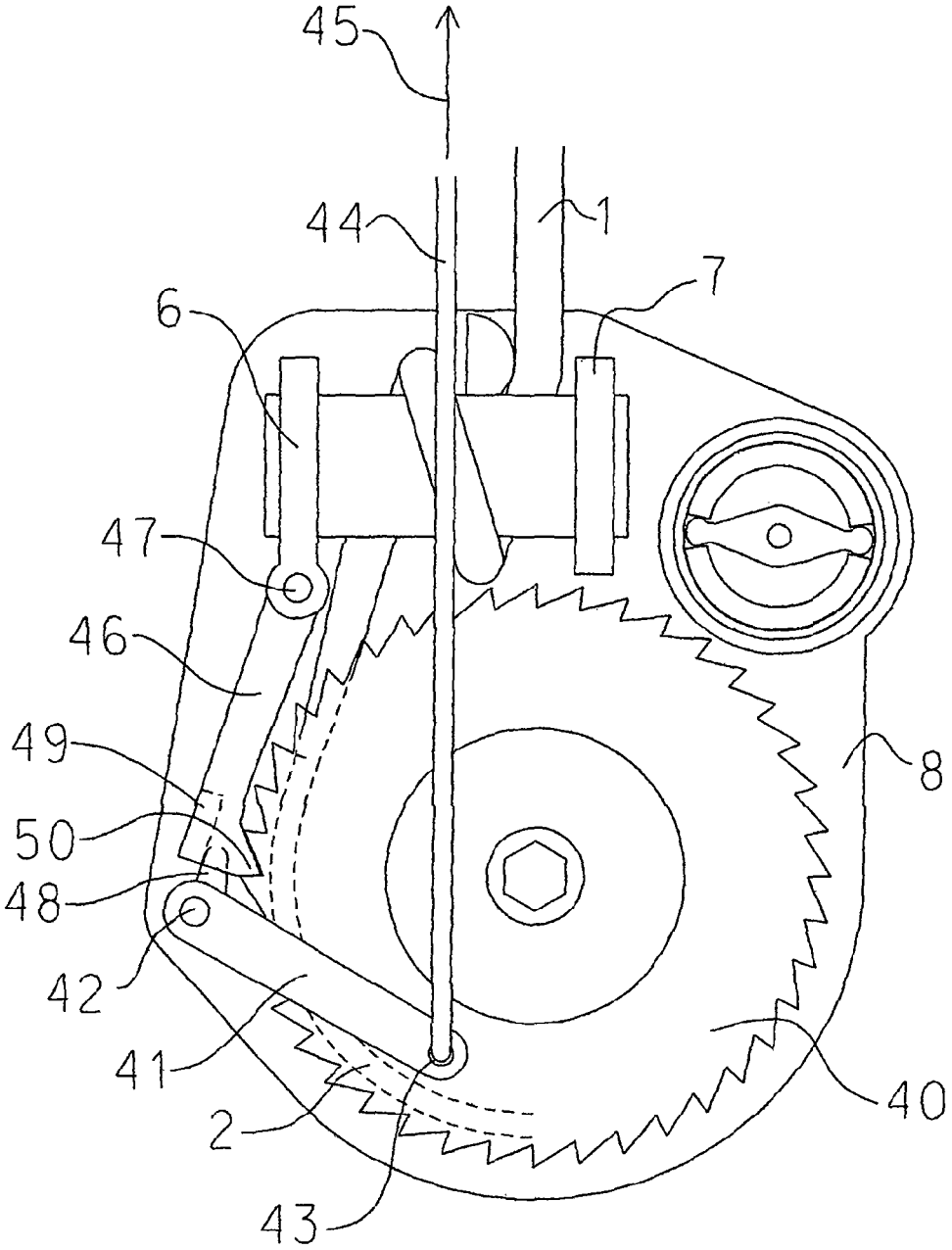
FIG. 6 shows an alternative release means with respect to the embodiment in FIG. 1.

FIG. 6 shows an alternative method for holding the drum when arresting a fall and then for releasing the drum to initiate descent. Drum 40 is similar to drum 9 in FIG. 1-5 except that the one or both flanges are profiled at their radial edge with a tooth form. Drum 40 is shown with the toothed profile extending around the circumference of one or both flanges although this profile could be limited to a part of the circumference. Link 46 is pivoted at one end about axle 47, axle 47 being attached to both bracket 6 and chassis 8 and at its other end is tooth 50 that is profiled to engage with the toothed profile around drum 40. In a first position in which drum 40 is held, tooth 50 is engaged with the tooth form on drum 40 thereby holding drum 40 from being free to rotate. Link 41 is pivoted about axle 42 at one end and has a protrusion 48 that engages with abutment 49 on link 46 whilst at its other end, link 41 has an attachment means 43 to which cord 44 is attached such that, in a second position, when cord 44 is pulled in the direction of arrow 45, link 41 rotates about axle 42 urging tooth 50 on link 46 to move away from drum 40 thereby allowing drum 40 to rotate.

In the embodiments shown in FIGS. 1 to 6, it is preferred to provide a housing to protect the height rescue apparatus from general abuse and wear and tear. In FIG. 2, housing 65 is shown as cut away and protects and encloses mechanical components to one side of chassis 8, particularly as shown in FIG. 5 such as spur gears 20, 30 and 31 and also, the critical mechanism for releasing the drum to allow a person to initiate descent. Housing 65 has apertures to allow access to both attachment 10 for attachment to a harness and cord 36 to enable it to be located in a convenient position for someone to pull when suspended in a harness. By limiting the housing to one side of chassis 8 it is possible to minimise weight. In other embodiments it may be preferable to extend the housing both sides of chassis 8 to provide protection for both drum 9 and lowering elongate 2 and in further embodiments, a housing may be provided by a flexible pouch that at least partially envelops the height rescue apparatus and could also provide some useful cushioning to protect the height rescue apparatus from severe impact. Such a pouch may be used instead of or in addition to other housings such as housing 65.

Figure 7:
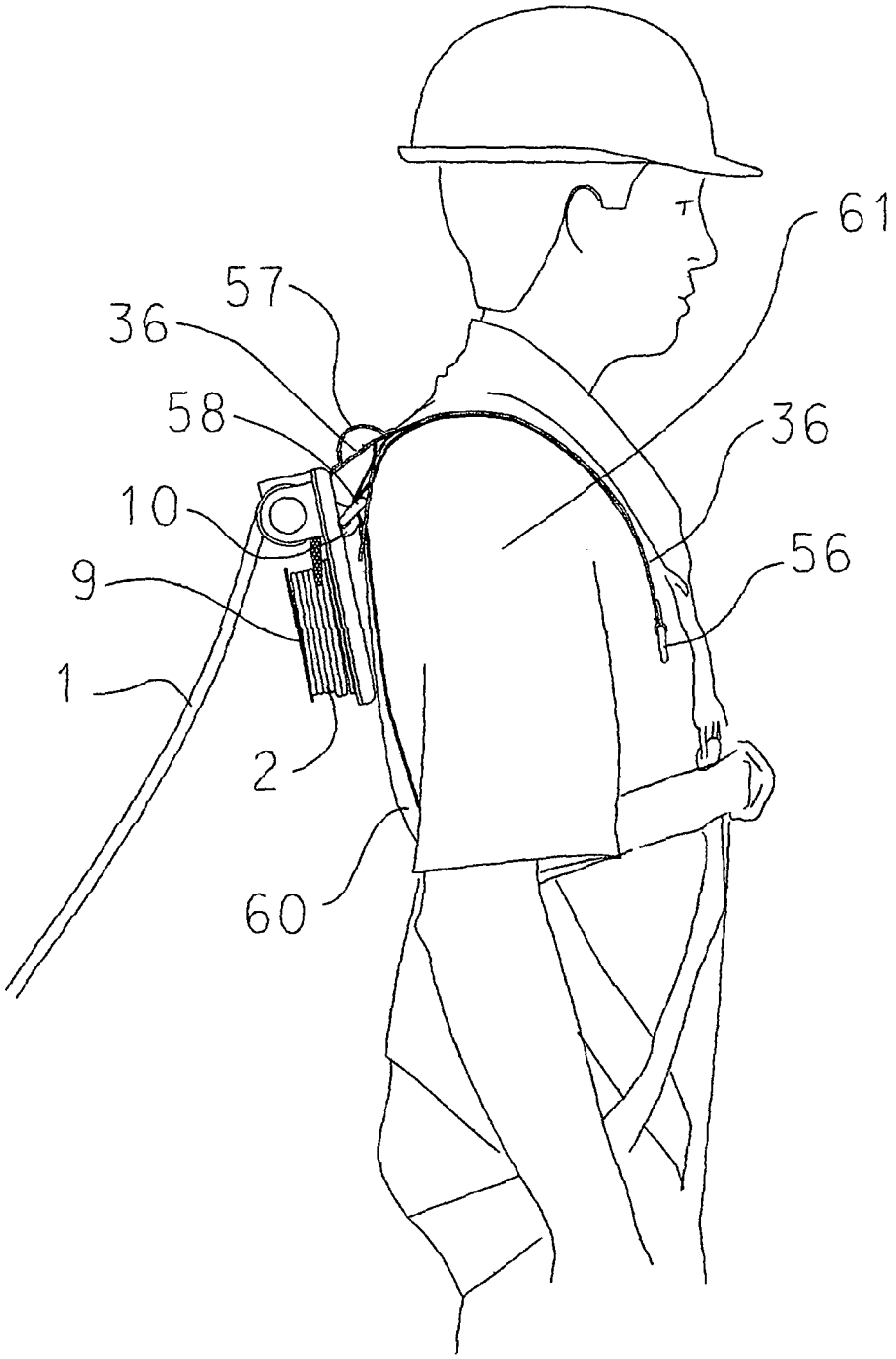
FIG. 7 shows the embodiment in FIGS. 1 to 5 attached to a harness worn by a person in use.

FIG. 7 shows the invention attached to harness 60 as worn by person 61. Harness 60 is typically made from webbing material that is entwined around the person's body to restrain the person relative to one or more attachments provided on the harness. In FIG. 7 attachment 58 is such an attachment that is shown as being located close to the person's upper back. Another typical attachment location is close to a person's chest and many harnesses provide a variety of attachment points in different locations that may be used singly or concurrently.

In FIG. 7, attachment 10 on the invention is shown as being securely attached to attachment 58 on harness 60. Elongate 1 is a safety line that is attached at one to a secure anchor and at its other end to elongate 2 that is wound onto drum 9, elongate 1 having a significantly larger cross sectional area than elongate 2, and thus significantly greater tensile strength. The invention in FIG. 7 is shown for illustration purposes with elongate 2 having a circular cross section of approximately 5 mm and a length of approximately 20 mm wound onto drum 9, providing a lightweight and compact device for a person to wear on a harness whilst working at height. Cord 36 is a pull cord attached at one end to a mechanism such as in FIG. 5 and FIG. 6 that in a first position prevents rotation of drum 9. Ring 56 is attached to the other end of cord 36 such that when ring 56 and cord 36 is pulled, the said mechanism moves to a second position allowing rotation of drum 9 and also therefore the deployment of elongate 2. Loop 57 is attached to or part of cord 36 and enables someone other than person 61 to access and pull cord 36 in the event that person 61 is injured during a fall. Loop 57 may be engaged in a variety of ways, a typical method being using an extending pole from a higher position. It is preferred to guide cord 36 relative to person 61 so that ring 56 is in a convenient position for person 61 to pull it whilst suspended. When the invention is attached close to a person's upper back, the harness strap around the person's shoulder may provide a useful attachment for guidance means for cord 36.

FIG. 8*a* shows person 61 suspended in harness 60 such as after a fall. Drum 9 is held in a first position to prevent its rotation so that person 61 is suspended relative to the secure anchor to which elongate 1 is attached. Whilst arresting a fall, a substantial proportion of the fall load is sustained by the safety line elongate 1. Tension in elongate 1 is reduced by friction means such as is shown in FIGS. 1 and 2 so that elongate 2 and its attachment to elongate 1 is only required to sustain 50% or less of the applied tension in elongate 1. In order to initiate the person's descent, cord 36 is pulled to release drum 9 such that it can rotate. The speed of rotation of drum 9 is controlled by a speed sensitive control mechanism such as is shown in FIG. 4, so that when cord 36 is pulled, person 61 descends at a controlled speed to the ground or some other safe level. In typical applications, the descent speed of person 61 is preferably maintained between 1 and 2 meters per second.

In typical embodiments it may be convenient to initiate a person's descent after a fall using electrical actuation. Link 32 in FIG. 5 or link 41 in FIG. 6 could be easily adapted to be rotated either by direct electrical actuation or by an actuator pulling cord 36 in FIG. 5 or cord 44 in FIG. 6. Typical actuators include devices such as an electrical motor, solonoid or any other suitable actuator. An actuator may be part of a circuit energised by a battery that is left in an open state until actuation is required. A simple switch could then close the circuit to initiate actuation. It would be straightforward to locate the said switch so a person suspended can conveniently operate it and/or another person in the event that the person suspended is injured. A more sophisticated embodiment could control the switching function using radio or infrared communications. The benefit of this arrangement is that if the suspended person were injured, it would be easy for another person to initiate the person's descent from a safe remote location.

All aforementioned references to flexible elongate refer to flexible elongate that may be made from any suitable material and with any suitable cross section.

The described embodiments differ in their details but they are linked by common principles. Accordingly, it will be understood by a person skilled in the art that these are merely illustrative although variations are possible within the scope of the claims, which follow.

The invention claimed is:

1. A height rescue apparatus having both a fall arrest function and a lowering function, the apparatus comprising:

an elongate safety line which in use has one end secured with respect to a secure anchorage device;

a friction device for effecting the fall arrest function and mounted on a bracket having harness attachment means, said friction device acting upon a portion of the safety line towards an other end thereof remote from said one end in order to reduce tension in said other end of said safety line by at least 50% in a fall arrest situation;

an elongate lowering line which has a first end attached to said other end of the safety line and which has a lower tensile strength than the safety line;

a drum mounted on the bracket for rotation relative thereto, around which drum the lowering line is wound and to which drum the second end of the lowering line is secured, said drum being independent of said friction device, at least one speed control means for controlling a speed of rotation of the drum when the apparatus is in its lowering function, one of the drum or the speed control means being releasably held in a first position which prevents rotation of the drum when the apparatus is in its fall arrest function, release means for releasing the drum or the at least one speed control means from said first position to allow the drum to effect said lowering function by rotating at a controlled speed in a lowering situation thereby allowing lowering line to be deployed to provide a controlled descent speed.

2. The height rescue apparatus as claimed in claim 1 wherein the friction device is a dynamic friction device in which the friction applied to the safety line is a function of the tensile load in the safety line between said friction device and said one end of the safety line.

3. The height rescue apparatus as claimed in claim 2 wherein the friction applied to the safety line is directly proportional to the tensile load in the safety line.

4. The height rescue apparatus as claimed in claim 1, wherein the friction device comprises at least one fixed member against which the safety line is constrained in a fall arrest situation.

5. The height rescue apparatus as claimed in claim 4 wherein said at least one member interacts with the safety line in such a way that the safety line is constrained to follow a non-linear path relative to the bracket.

6. The height rescue apparatus as claimed in claim 5 wherein said at least one member comprises a cylinder of round cross-section which is fixedly secured to the bracket, the safety line passing around the circumference of the cylinder.

7. The height rescue apparatus as claimed in claim 6 wherein the safety line contacts the cylinder over a radial angle of at least $2\pi$ radians.

8. The height rescue apparatus as claimed in claim 4, wherein the tension in the safety line in a fall arrest situation is represented by the formula $$\frac{T_1}{T_2} = e^{\mu\theta}$$

in which $T_1$ is the applied tension at said one end of the safety line, $T_2$ is the tension in the safety line downstream of the friction device, $\mu$ is the coefficient of friction between the surface of the elongate 1 and the surface of said at least one member, and $\theta$ is the radial angle in radians of contact between the safety line and said at least one member.

9. The height rescue apparatus as claimed in claim 4 wherein the friction device comprises a clamping mechanism acting on opposite sides of the safety line.

10. The height rescue apparatus as claimed in claim 9 wherein the clamping mechanism comprises said at least one fixed member which provides a fixed clamping surface and further comprises a movable clamping surface which is able to move towards and away from the fixed clamping surface.

11. The height rescue apparatus as claimed in claim 10 wherein the movable clamping surface is provided on a clamp arm which is pivotally secured with respect to the bracket on one side of the clamping surface and is acted upon by a harness connection such that tension on the harness connection due to a fall arrest causes the movable clamping surface to move towards the fixed clamping surface thereby increasing friction between the safety line and the clamping surfaces and reducing tension on said other end of the safety line.

12. The height rescue apparatus as claimed in claim 11 wherein the safety line is guided by guides upstream and downstream of the fixed clamping surface.

13. The height rescue apparatus as claimed in claim 11 wherein the harness connection comprises a length of rope looped around a pin provided on the clamp arm.

14. The height rescue apparatus as claimed in claim 10, wherein the clamping surfaces are linear and are contoured to fit the cross-section of the safety line.

15. The height rescue apparatus as claimed in claim 1, wherein the safety line and the lowering line are attached together by one of the following methods: splicing, interconnection of looped ends, sewing, knotting, interconnecting mechanical links.

16. The height rescue apparatus as claimed in claim 1, wherein said speed control means includes a centrifugal brake mechanism comprising said drum being threadedly attached to a nut which is held against a drive gear so that they rotate together, the drive gear driving in rotation a shoe drive having mounted thereon shoes for engagement with a brake lining material, and wherein said speed control means further comprises a brake material provided between the drum and a chassis.

17. The height rescue apparatus as claimed in claim 1 wherein said one end of the safety line is attached to a D-ring to which a safety lanyard is attached, the safety lanyard being adapted to be secured to the secure anchorage.

18. The height rescue apparatus as claimed in claim 1, wherein said release means comprises a pull cord attached to a lever mechanism adapted to release the drum or the at least one speed control means.

19. The height rescue apparatus as claimed in claim 1, wherein the release means is electrically actuated.

20. The height rescue apparatus as claimed in claim 19, wherein the electrical actuation is by remote control.

* * * * *